United States Patent [19]

Hata et al.

[11] Patent Number: 4,609,480

[45] Date of Patent: Sep. 2, 1986

[54] LUBRICANT COMPOSITION FOR IMPROVING FATIGUE LIFE

[75] Inventors: Hitoshi Hata; Akira Sasaki; Hisao Yamada, all of Ichihara, Japan

[73] Assignee: Idemitsu Kosan Company Limited, Tokyo, Japan

[21] Appl. No.: 761,652

[22] Filed: Jul. 31, 1985

Related U.S. Application Data

[63] Continuation of Ser. No. 648,974, Sep. 10, 1984, abandoned.

[30] Foreign Application Priority Data

Sep. 19, 1983 [JP] Japan ..... 58-171182

[51] Int. Cl.[4] ..... C10M 105/8; C10M 105/72

[52] U.S. Cl. ..... 252/32.7 E; 252/47; 252/47.5; 252/56 R

[58] Field of Search ..... 252/47, 47.5, 32.7 E, 252/56 R

[56] References Cited

U.S. PATENT DOCUMENTS 2,719,126 9/1955 Fields et al. ..... 252/47
3,890,363 6/1975 Malec ..... 252/47.5
4,360,438 11/1982 Rowan et al. ..... 252/47.5
4,501,678 2/1985 Katayama et al. ..... 252/32.7 E

FOREIGN PATENT DOCUMENTS 0138407 12/1978 Japan ..... 252/47

*Primary Examiner*—William R. Dixon, Jr.
*Assistant Examiner*—Margaret B. Medley
*Attorney, Agent, or Firm*—Frishauf, Holtz, Goodman & Woodward

[57] ABSTRACT

The lubricant composition of the invention is very effective in extending the fatigue life and increasing the corrosion resistance of the machine parts lubricated therewith. The lubricant composition comprises two types of essential additives of (a) a dithiocarbamic acid ester and/or an alkyl thiocarbamoyl compound and (b) a 1,3,4-thiadiazole compound admixed with the lubricant base material each in a limited amount. In addition to the above mentioned advantages, the resistance against scoring can further be increased by the admixture of the lubricant composition with a third additive (c) such as sulfurized olefins, sulfurized oils, sulfurized oxymolybdenum dithiocarbamates, sulfurized oxymolybdenum organophosphorodithioates, phosphoric acid esters and phosphorous esters.

14 Claims, No Drawings

LUBRICANT COMPOSITION FOR IMPROVING FATIGUE LIFE

This application is a continuation of application Ser. No. 648,974, filed Sept. 10, 1984, now abandoned.

BACKGROUND OF THE INVENTION

The present invention relates to a lubricant composition for improving fatigue life, more particularly, to a lubricant composition capable of extending the fatigue life of machine parts such as gears and bearings and imparting corrosion resistance thereto by virtue of specific additives admixed with a lubricant base material.

As is known, the lubricant used for the lubrication of gears, bearings and the like should have high anti-scoring performance because these machine parts must withstand a very high pressure when they are in operation. Recent investigations of these machine parts after actual use, however, have revealed that the phenomenon of scoring takes place very rarely and most of troubles in these machine parts are ascribable to the damages by fatigue such as pitting and the like.

In view of the above circumstances, various types of lubricant compositions for extending fatigue life of machine parts have been developed and proposed in the prior art technology of lubrication. For example, Takao Katayama and Masahiko Takesue, fellow employees of the inventors of the present application have developed a lubricant composition for improving fatigue life by formulating a specific sulfur compound to a lubricant base material as is disclosed in Japanese Patent Kokai No. 59-11397 (U.S. Ser. No. 500,264) now Pat. No. 4,501,678. The performance of this improved lubricant composition is, however, not quite satisfactory and it is eagerly desired to develop a further improved lubricant composition in respect of not only extension of the fatigue life but also corrosion resistance of the machine parts lubricated therewith.

SUMMARY OF THE INVENTION

Thus, an object of the present invention is to provide a lubricant composition capable of extending the fatigue life of the machine parts lubricated therewith.

Another object of the invention is to provide a lubricant composition capable of imparting corrosion resistance to the machine parts lubricated therewith along with the above mentioned extension of fatigue life.

The lubricant composition for extending fatigue life of the present invention comprises:

(a) a dithiocarbamic acid ester and/or an alkyl thiocarbamoyl compound; and (b) a 1,3,4-thiadiazole compound, each admixed with a lubricant base material.

The inventive lubricant composition may further comprise:

(c) a third additive selected from the group consisting of a sulfurized olefin, sulfurized oil, sulfurized oxymolybdenum organophosphorodithioate, sulfurized oxymolybdenum dithiocarbamate, phosphoric acid ester and phosphorous ester.

DETAILED DESCRIPTION OF THE INVENTION

The inventive lubricant composition comprises a lubricant base material and the above mentioned additives (a), (b) and, optionally, (c) admixed with the base material. The lubricant base material suitable as the base component of the inventive lubricant composition includes conventional lubricant oils and greases without particular limitations. The lubricant oil may be a mineral oil, a synthetic oil or a mixture thereof.

The additive (a) is an ester of a dithiocarbamic acid or an alkyl thiocarbamoyl compound but it is of course to add these two types of the compounds in combination.

The dithiocarbamic acid ester is a compound represented by the general formula

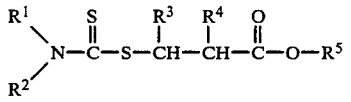

(I)

in which $R^1$, $R^2$ and $R^5$ are each an alkyl group having from 1 to 18 carbon atoms, $R^3$ is a hydrogen atom or an ester group —$COOR^5$ and $R^4$ is a hydrogen atom or methyl group. Exemplary of such a dithiocarbamic acid ester compound are:

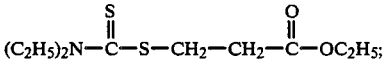

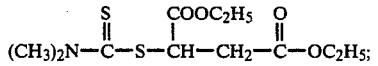

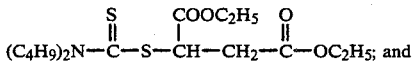

and

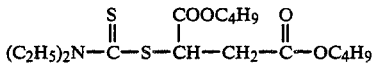

The additive (a) of the alternative type is an alkyl thiocarbamoyl compound which is a compound represented by the general formula

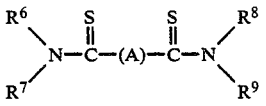

(II)

in which $R^6$, $R^7$, $R^8$ and $R^9$ are each an alkyl group having from 1 to 20 carbon atoms, each of the pairs of $R^6$ and $R^7$, and $R^8$ and $R^9$ optionally forming a ring structure as combined together with the nitrogen atom to which they are bonded, and (A) is a (poly)sulfide linkage selected from the group consisting of S, S—S, S—S—S, S—S—S—S, S—S—S—S—S and S—S—S—S—S—S or a group S—$(CH_2)_n$—S, n being an integer of 1, 2 or 3. Exemplary of such an alkyl thiocarbamoyl compound of the general formula (II) are: methylenebis(dibutyldithiocarbamate); bis(dimethylcarbamoyl)monosulfide; bis(dibutylthiocarbamoyl)monosulfide; bis(dimethylcarbamoyl)disulfide; bis(dibutylcarbamoyl)disulfide; bis(dibutylthiocarbamoyl)disulfide; bis(diamylcarbamoyl)disulfide; bis(diamylthiocarbamoyl)disulfide; bis(dioctylcarbamoyl)disulfide; bis(dioctylthiocarbamoyl)disulfide; tetraamyl thiocarbamoyl sulfide; bis(diamylthiocarbamoyl)monosulfide; di(pentamethylenethiocarbamoyl)hexasulfide and the like. These compounds and similar compounds are described in the specification of U.S. Ser. No. 500,264.

The amount of the above described additive (a) in the inventive lubricant composition should be in the range from 0.01 to 10% by weight, preferably, from 0.5 to 5% by weight. The lubricant composition cannot exhibit extension of the fatigue life by the omission of or with an insufficient amount of addition of the additive (a).

The other essential additive, i.e., the additive (b), in the inventive lubricant composition is a 1,3,4-thiadizole compound represented by the general formula

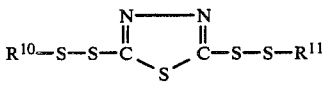

(III)

in which $R^{10}$ and $R^{11}$ are each an alkyl group having from 1 to 30 carbon atoms. Exemplary of such a 1,3,4-thiadiazole compound are:

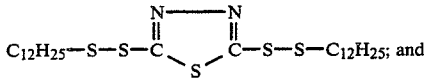

; and

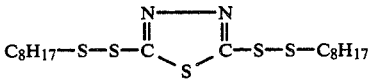

The amount of the above described additive (b) in the inventive lubricant composition should be in the range from 0.005 to 1% by weight, preferably, from 0.05 to 0.5% by weight. No sufficient corrosion resistance and extension of fatigue life can be obtained with the lubricant composition when the additive (b) is omitted or the amount thereof is smaller than the above range.

When lubricated with the inventive lubricant composition containing the additives (a) and (b) in the amounts specified above, the fatigue life of a machine part can be extended approximately twice in comparison with a mineral oil without the addition of these additives.

In addition to the above described essential additives (a) and (b), the inventive lubricant composition may further contain a third additive (c) when further improvement in the fatigue life extension and resistance against scoring is desired. The additive (c) is selected from the group of several compounds including sulfurized olefins, sulfurized oils, sulfurized oxymolybdenum organophosphorodithioates, sulfurized oxymolybdenum dithiocarbamates, phosphoric acid esters and phosphorous esters.

The sulfurized olefins suitable for use include various kinds of sulfurized olefins and polyolefins such as a sulfurized product of an olefin having from 16 to 18 carbon atoms per molecule and a sulfurized product of a polybutene of an average molecular weight of about 600 containing about 40% by weight of sulfur. The sulfurized oil is examplified by a sulfurized lard, sulfurized oleyl oleate, sulfurized myristyl oleate and the like. The sulfurized oxymolybdenum organophosphorodithioate is exemplified by sulfurized oxymolybdenum diisopropyl phosphorodithioate, sulfurized oxymolybdenum diisobutyl phosphorodithioate, sulfurized oxymolybdenum(2-ethylhexyl)phosphorodithioate, sulfurized oxymolybdenum(p-tert-butylphenyl)-phosphorodithioate, sulfurized oxynolybdenum(nonylphenyl)phosphorodithioate and the like. These compounds and similar compounds are described in the specification of U.S. Ser. No. 500,264. The sulfurized oxymolybdenum dithiocarbamate is exemplified by sulfurized molybdenum diethyldithiocarbamate, sulfurized molybdenum dipropyldithiocarbamate, sulfurized molybdenum dibutyldithiocarbamate, sulfurized molybdenum diamyldithiocarbamate, sulfurized molybdenum di(2-ethylhexyl)dithiocarbamate, sulfurized molybdenum dilauryldithiocarbamate, sulfurized molybdenum di(nonylpheyl)dithiocarbamate, sulfurized molybdenum di(cyclohexyl)dithiocarbamate and the like. Further, the phosphoric acid ester is exemplified by mono-, di- or tri-butyl phosphate, mono-, di- or tri-(2-ethylhexyl)phosphate, mono-, di- or tri-lauryl phosphate, mono-, di- or tri-oleyl phosphate and the like. The phosphorous ester is exemplified by mono-, or di- or tri-butyl phosphite, mono-, di- or tri-lauryl phosphite, mono-, di- or tri-stearyl phosphite, mono-, di- or tri-oleyl phosphite, mono-, di- or tri-phenyl phosphite, diethylamine salt of dibutyl hydrogenphosphite and the like. The phosphoric acid ester or phosphorous ester here implied contain a reaction product with an amine compound, too.

The above named compounds for the additive (c) may be used either singly or as a combination of two kinds or more according to need. The amount of the additive (c) in the inventive lubricant composition, although it is an optical ingredient therein, should be in the range from 0.01 to 30% by weight, preferably, from 0.05 to 10% by weight when an substantial improvement is desired by the addition thereof in the fatigue-life extension and resistance against scoring.

In addition to the above described additives (a), (b) and (c), it is of course optional that the inventive lubricant composition is formulated with other conventional additives used in lubricant compositions such as antioxidants, rust preventives, corrosion inhibitors, antifoaming agents and the like according to need.

The lubricant composition of the invention can be used in any machine parts such as gears, bearings and the like by applying to the surface thereof by coating, spraying, dipping or other conventional means. The machine part lubricated with the inventive lubricant composition is imparted with a greatly extended fatigue life along with excellent corrosion resistance. Further, the inventive lubricant composition admixed with the additive (c) exhibits a very excellent performance in respect of the resistance against scoring and wearing of the machine part lubricated therewith. Accordingly, the lubricant composition of the invention, which may be in an oily or greasy form, has a wide applicability as a lubricant oil such as a gear oil, bearing oil and the like as well as a lubricant grease used in a variety of applications.

Following are the examples and comparative examples to illustrate the formulation and advantages of the inventive lubricant composition in more detail.

EXAMPLES 1 TO 10 AND COMPARATIVE EXAMPLES 1 TO 4

Lubricant compositions were prepared each according to the formulation indicated in Table 1 below and they were subjected to the evaluation tests for the properties given below according to the procedures described. The results are summarized in Table 1.

(1) Fatigue life

Using the double-cylinder testing machine described in Japanese Patent Kokai No. 59-11397, the two cylinders constituting the driving test piece and the driven test piece were repeatedly brought into rolling contact and sliding contact to estimate the difference in the fatigue life. The test pieces, the testing conditions and the criteria for the evaluation of the fatigue life were as follows.

Test pieces

Material: SCM-3 for each of the driving and driven pieces

Diameter×width: 60 mm×20 mm for each of the driving and driven pieces

Hardness (HB): 350 for the driving piece and 300 for the driven piece

Surface roughness ($R_{max}$): 3 μm for each of the driving and driven pieces

Testing conditions

Velocity of revolution: 1500 r.p.m.

Sliding ratio: −18%

Sliding velocity: 0.7 m/second

Contacting pressure ($H_{max}$): 75 kg/mm$^2$

The corrosion resistance was evaluated according to the procedure for the corrosion test of copper plate specified in JIS K 2513.

(3) Resistance against scoring

The resistance against scoring was evaluated according to the procedure of Timken test specified in ASTM D2782.

As is clear from the results shown in Table 1, the fatigue life with the inventive lubricant composition containing the additives (a) and (b) is about twice long in comparison with the value with the mineral oil and addition of the additive (c) to the lubricant composition is still more effective in the extension of the fatigue life along with the improvement in the resistance against scoring. The corrosion resistance is poor and the extension of the fatigue life is insufficient when the additive (b) is omitted and no extension of the fatigue life can be obtained by the omission of the additive (a).

TABLE 1

| | EXAMPLE | | | | | | | | | | COMPARATIVE EXAMPLE | | | |
|---|---|---|---|---|---|---|---|---|---|---|---|---|---|---|
| | 1 | 2 | 3 | 4 | 5 | 6 | 7 | 8 | 9 | 10 | 1 | 2 | 3 | 4 |
| COMPOSITION | | | | | | | | | | | | | | |
| Mineral Oil (Paraffinic type, 500 Neutral) | 99.75 | 99.65 | 99.40 | 99.00 | 99.20 | 98.30 | 98.30 | 98.30 | 98.30 | 98.30 | 99.0 | 98.50 | 98.80 | 100 |
| Component (a) | | | | | | | | | | | | | | |
| S—1,2-dicarboethoxyethyl-N,N—di-n-butyldithiocarbamate | 0.20 | — | — | — | 0.50 | 0.50 | 0.50 | — | — | — | — | 0.50 | — | — |
| S—carboethoxyethyl-N,N—diethyldithiocarbamate | — | 0.3 | — | — | — | — | — | 0.50 | 0.50 | 0.50 | — | — | — | — |
| Bis(dibutylcarbamoyl) disulfide | — | — | 0.50 | — | — | — | — | — | — | — | — | — | — | — |
| Bis(diamylcarbamoyl) disulfide | — | — | — | 0.80 | — | — | — | — | — | — | — | — | — | — |
| Component (b) | | | | | | | | | | | | | | |
| 2,5-Bis(n-dodecyldithio)-1,3,4-thiadiazole | 0.05 | — | 0.10 | — | 0.30 | — | 0.20 | — | — | 0.20 | — | — | 0.20 | — |
| 2,5-Bis(octylthio)-1,3,4-thiadiazole | — | 0.05 | — | 0.20 | — | 0.20 | — | 0.20 | 0.20 | — | — | — | — | — |
| Component (c) | | | | | | | | | | | | | | |
| Sulfurized olefin*1 | — | — | — | — | — | 1.00 | — | — | — | — | 1.00 | 1.00 | 1.00 | — |
| Sulfurized lard*2 | — | — | — | — | — | — | 1.00 | — | — | — | — | — | — | — |
| MoDTP*3 | — | — | — | — | — | — | — | 1.00 | — | — | — | — | — | — |
| MoDTC*4 | — | — | — | — | — | — | — | — | 1.00 | — | — | — | — | — |
| Phosphoric acid ester*5 | — | — | — | — | — | — | — | — | — | 1.00 | — | — | — | — |
| Fatigue Life (relative value) | 204 | 212 | 194 | 206 | 220 | 238 | 246 | 245 | 254 | 226 | 124 | 160 | 158 | 100 |
| Corrosion Resistance | 1(1a) | 1(1a) | 1(1a) | 1(1a) | 1(1a) | 1(1a) | 1(1a) | 1(1a) | 1(1a) | 1(1a) | 4(4a) | 3(3b) | 1(1a) | 1(1a) |
| Resistance Against Scoring | 21 | 21 | 24 | 24 | 24 | 50 | 50 | 50 | 50 | 40 | 40 | 40 | 40 | 3 |

*1"Anglamol 33" (produced by Lubrizol Corp.)
*2"DAILUBE S-270" (produced by Dainippon Ink Co., Ltd.)
*3Sulfurized oxymolybdenum (2-ethylhexyl)phosphorodithioate
*4Sulfurized molybdenum diamyldithiocarbamate
*5Mono-oleyl phosphate Criteria for the evaluation The contacting surfaces of the test pieces were visually examined by interrupting the rotation of the machine after each three hours running and the fatigue life was determined by the number of contacting, i.e. velocity of revolution×time, before appearance of 10 spots of damage each having a dimension of at least 0.5 mm on the surface of the driven test piece. The thus obtained values were used for the calculation of the life $L_{50}$ for the 50% damage occurrence with reference to the Weibull's distribution curve. The life value $L_{50}$ was determined according to the above described procedure and the value was expressed in a relative percentage based on the $L_{50}$ value obtained with a paraffinic base oil as a control which was $4.7\times10^6$.

(2) Corrosion resistance

What is claimed is:

1. A lubricant composition for improving fatigue life which comprises a lubricating base material containing the additives (a) from 0.01 to 10% by weight of at least one compound selected from the group consisting of (i) a dithiocarbamic acid ester of the formula

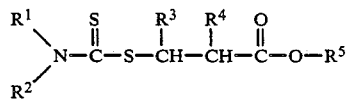

(I)

wherein $R^1$, $R^2$ and $R^5$ are each an alkyl group having from 1 to 18 carbon atoms, $R^3$ is a hydrogen atom or an ester group of the formula —$COOR^5$ and $R^4$ is a hydrogen atom or methyl group;

(ii) an alkyl thiocarbamoyl compound of the formula

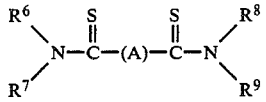

(II)

wherein $R^6$, $R^7$, $R^8$ and $R^9$ are each an alkyl group having from 1 to 20 carbon atoms, each of the pairs of $R^6$ and $R^7$, and $R^8$ and $R^9$ may form a ring structure with the nitrogen atom to which the groups $R^6$ and $R^7$ or $R^8$ and $R^9$ are bonded, and (A) is a sulfide or polysulfide linkage selected from the group consisting of S, S—S, S—S—S, S—S—S—S, S—S—S—S—S, and S—S—S—S—S—S or a linkage of the formula $S—(CH_2)_n—S$, n being an integer of 1, 2 or 3; and (b) from 0.005 to 1% by weight of a 1,3,4-thiadiazole compound of the formula

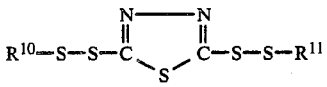

(III)

wherein $R^{10}$ and $R^{11}$ are each an alkyl group having from 1 to 30 carbon atoms.

2. The composition of claim 1 wherein said additive (a) is in an amount from 0.05 to 5% by weight.

3. The composition of claim 2 wherein said additive (b) is in an amount from 0.05 to 0.5% by weight.

4. The composition of claim 1 wherein said additive (b) is in an amount from 0.05 to 0.5% by weight.

5. The composition of claim 3 wherein said additive (a) is selected from the group consisting of S-1,2-dicarboethoxyethyl-N,N-di-n-butyldithiocarbamate, S-carboethoxyethyl-N,N-diethyldithiocarbamate, bis(dibutylcarbamoyl)disulfide and bis(diamylcarbamoyl)disulfide; and wherein said additive (b) is selected from the group consisting of 2,5-bis(n-dodecyldithio)-1,3,4-thiadiazole and 2,5-bis(octylthio)-1,3,4-thiadiazole.

6. The composition of claim 1 wherein said additive (a) is selected from the group consisting of S-1,2-dicarboethoxyethyl-N,N-di-n-butyldithiocarbamate, S-carboethoxyethyl-N,N-diethyldithiocarbamate, bis(dibutylcarbamoyl)disulfide and bis(diamylcarbamoyl)disulfide; and wherein said additive (b) is selected from the group consisting of 2,5-bis(n-dodecyldithio)-1,3,4-thiadiazole and 2,5-bis(octylthio)-1,3,4-thiadiazole.

7. A lubricant composition for improving fatigue life which comprises a lubricating base material containing the additives (a) from 0.01 to 10% by weight of at least one compound selected from the group consisting of (i) a dithiocarbamic acid ester of the formula

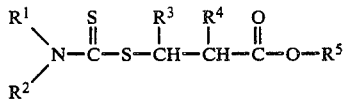

(I)

wherein $R^1$, $R^2$ and $R^5$ are each an alkyl group having from 1 to 18 carbon atoms, $R^3$ is a hydrogen atom or an ester group of the formula —$COOR^5$ and $R^4$ is a hydrogen atom or methyl group;

(ii) an alkyl thiocarbamoyl compound of the formula

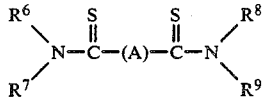

(II)

wherein $R^6$, $R^7$, $R^8$ and $R^9$ are each an alkyl group having from 1 to 20 carbon atoms, each of the pairs of $R^6$ and $R^7$, and $R^8$ and $R^9$ may form a ring structure with the nitrogen atom to which the groups $R^6$ and $R^7$ or $R^8$ and $R^9$ are bonded, and (A) is a sulfide or polysulfide linkage selected from the group consisting of S, S—S, S—S—S, S—S—S—S, S—S—S—S—S, and S—S—S—S—S—S or a linkage of the formula $S—(CH_2)_n—S$, n being an integer of 1,2 or 3;

(b) from 0.005 to 1% by weight of a 1,3,4-thiadiazole compound of the formula

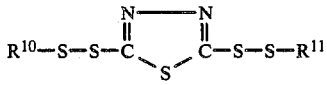

(III)

wherein $R^{10}$ and $R^{11}$ are each an alkyl group having from 1 to 30 carbon atoms; and (c) an additive selected from the group consisting of sulfurized olefins, sulfurized oils, sulfurized oxymolybdenum organophosphorodithioates, sulfurized oxymolybdenum dithiocarbamates, phosphoric acid esters and phosphorous esters.

8. The composition of claim 7 wherein said additive (c) is in an amount from 0.1 to 30% by weight.

9. The composition of claim 8 wherein said additive (c) is in an amount from 0.5 to 10% by weight.

10. The composition of claim 9 wherein said additive (a) is selected from the group consisting of S-1,2-dicarboethoxyethyl-N,N-di-n-butyldithiocarbamate, S-carboethoxyethyl-N,N-diethyldithiocarbamate, bis(dibutylcarbamoyl)disulfide and bis(diamylcarbamoyl)disulfide; wherein said additive (b) is selected from the group consisting of 2,5-bis(n-dodecyldithio)-1,3,4-thiadiazole and 2,5-bis(octylthio)-1,3,4-thiadiazole; and said additive (c) is selected from the group consisting of a sulfurized olefin, a sulfurized lard, sulfurized oxymolybdenum (2-ethylhexyl)phosphorodithioate, sulfurized molybdenum diamylthiocarbamate, and monooleyl phosphate.

11. The composition of claim 8 wherein saiid additive (a) is selected from the group consisting of S-1,2-dicarboethoxyethyl-N,N-di-n-butyldithiocarbamate, S-carboethoxyethyl-N,N-diethyldithiocarbamate, bis(dibutylcarbamoyl)disulfide and bis(diamylcarbamoyl)disulfide; wherein said additive (b) is selected from the group consisting of 2,5-bis(n-dodecyldithio)-1,3,4-thiadiazole and 2,5-bis(octylthio)-1,3,4-thiadiazole; and said additive (c) is selected from the group consisting of a sulfurized olefin, a sulfurized lard, sulfurized oxymolybdenum (2-ethylhexyl)phosphorodithioate, sulfurized molybdenum diamylthiocarbamate, and monooleyl phosphate.

12. The composition of claim 9 wherein said additive (a) is in an amount from 0.05 to 5% by weight and said additive (b) is in an amount from 0.05 to 0.5% by weight.

13. The composition of claim 10 wherein said additive (a) is in an amount from 0.05 to 5% by weight and said additive (b) is in an an amount from 0.05 to 0.5% by weight.

14. The composition of claim 11 wherein said additive (a) is in an amount from 0.05 to 5% by weight and said additive (b) is in an amount from 0.05 to 0.5% by weight.

* * * * *